US005097969A

United States Patent [19]

Maxworthy

[11] Patent Number: 5,097,969

[45] Date of Patent: Mar. 24, 1992

[54] SHELF

[75] Inventor: John Maxworthy, North Merrick, N.Y.

[73] Assignee: International Visual Corporation, Port Washington, N.Y.

[21] Appl. No.: 706,983

[22] Filed: May 29, 1991

[51] Int. Cl.[5] ..... A47F 5/00

[52] U.S. Cl. ..... 211/153; 211/90; 108/152

[58] Field of Search ..... 211/153, 135, 90, 187, 211/88; 108/152

[56] References Cited

U.S. PATENT DOCUMENTS

| | | | |
|---|---|---|---|
| 2,169,295 | 8/1939 | Shuart | 211/153 |
| 3,320,011 | 5/1967 | Sachnoff et al. | 211/153 X |
| 3,556,309 | 1/1971 | Schreyer | 211/153 |
| 4,051,789 | 10/1977 | Howitt | 211/153 X |
| 4,240,557 | 12/1980 | Dickens | 211/153 |
| 4,467,927 | 8/1984 | Nathan | 211/153 |
| 4,535,898 | 8/1985 | Jones et al. | 211/153 |
| 4,572,381 | 2/1986 | Breakey et al. | 211/94 |

*Primary Examiner*—Robert W. Gibson, Jr.
*Attorney, Agent, or Firm*—Darby & Darby

[57] ABSTRACT

An injection-molded plastic shelf for use with slat walls has a top surface on which goods are supported and an opposite bottom surface. An integral tubular frame extends substantially peripherally around the bottom surface. The tubular frame has a wall that projects downwardly from said bottom surface and defines an internal bore of the tubular frame. A plurality of ribs is formed on the bottom surface integrally therewith for reinforcing the same. Each of the plurality of ribs has a longitudinal bore that extends therethrough and at least one end intersecting the wall of the tubular frame so that the bores of the ribs communicate with the internal bore of the tubular frame thus forming a network of communicating bores.

14 Claims, 2 Drawing Sheets

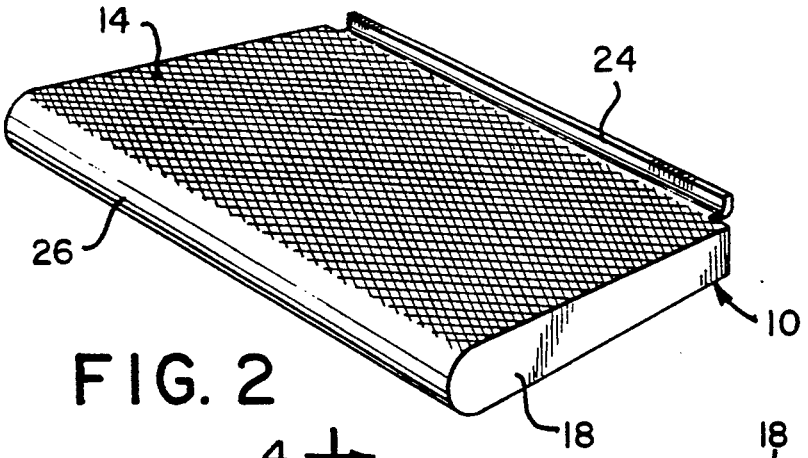
FIG. 1
FIG. 2
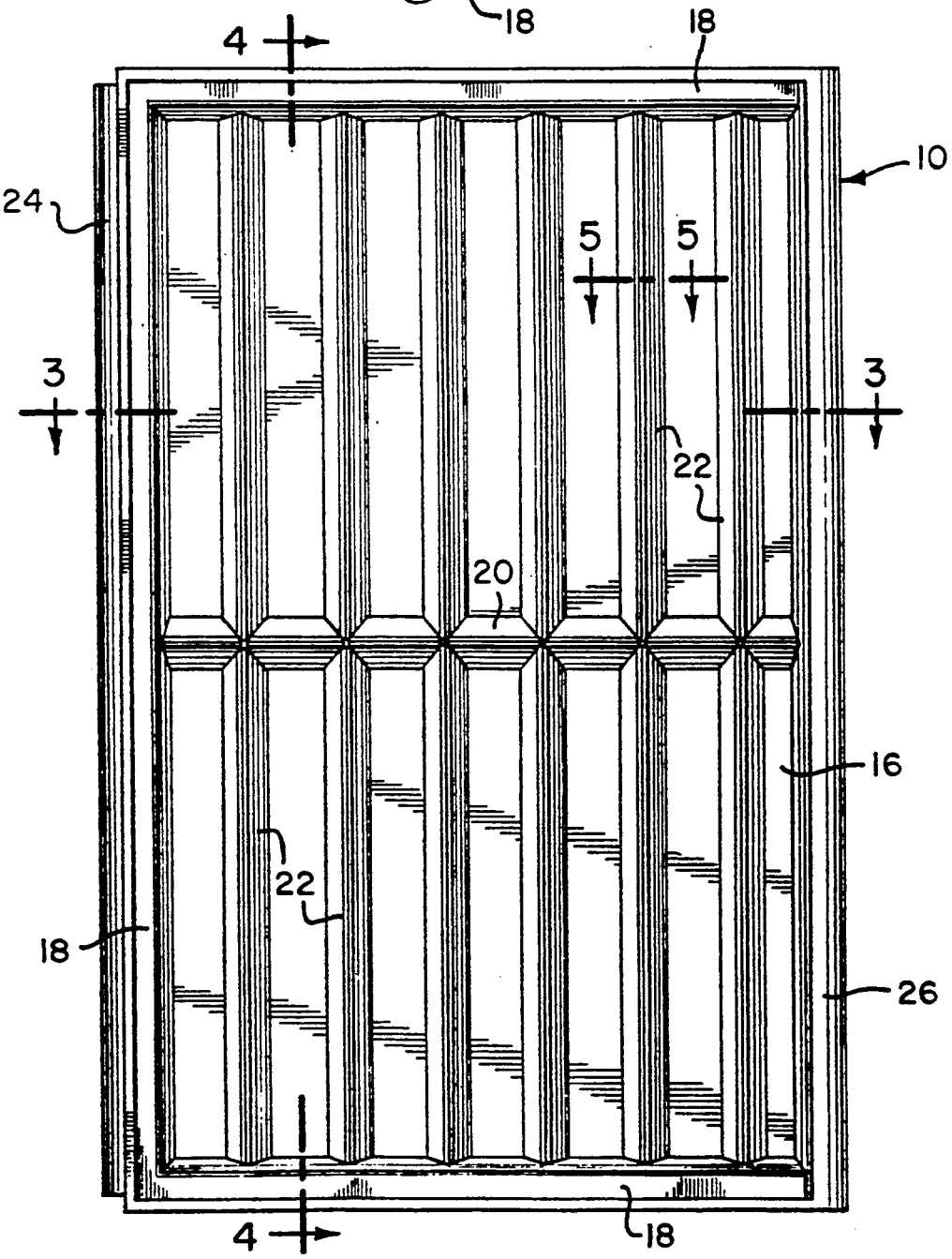

FIG. 3
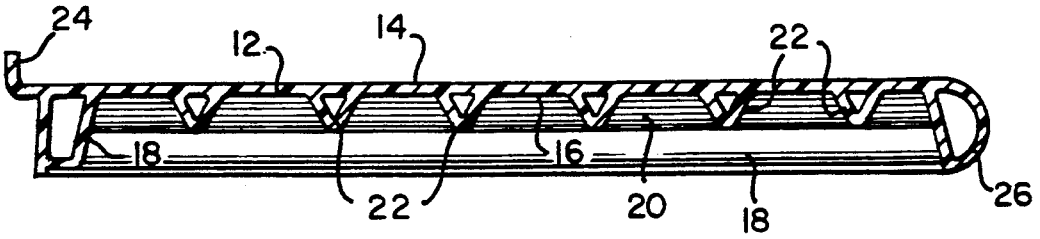
FIG. 4
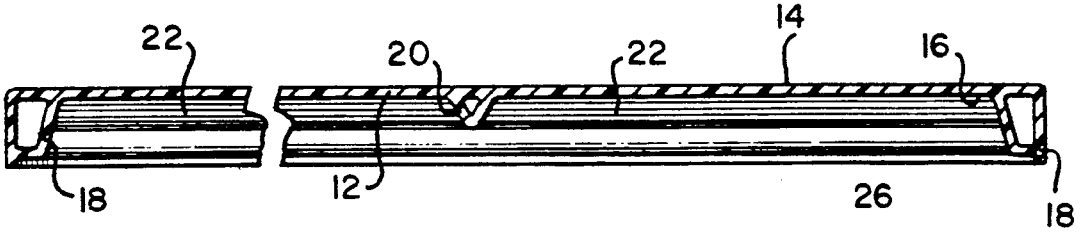
FIG. 5
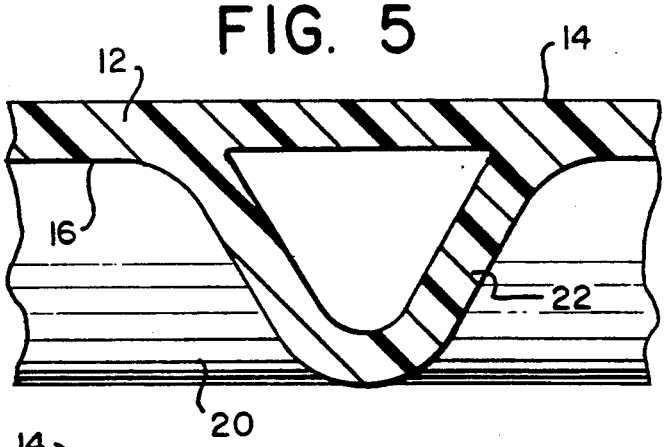
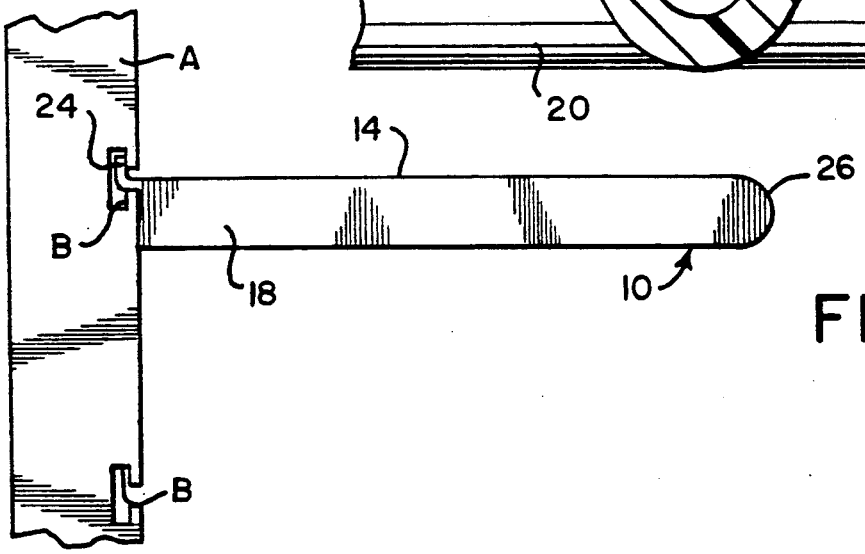
FIG. 6

SHELF

BACKGROUND OF THE INVENTION

1. Field of the Invention

The invention relates to a shelf for supporting goods in stores and supermarkets. In particular, the invention relates to a plastic shelf made by injection molding. Specifically, the invention relates to an injection-molded plastic shelf for use with a "slat wall".

2. Description of the Prior Art

Plastic shelves for supporting goods and used in supermarkets and other stores are well known. These shelves are usually supported by angular brackets attached to a wall or similar structure. It is also known to use injection-molded plastic shelves with "slat walls", walls that have grooves for connecting shelves thereto. Such "slat walls" have found an increased use in supermarkets and stores. However, because the shelves used with slat walls are supported in a cantilever manner, they must be particularly rigid. Furthermore, the fixation of such shelf to the slat wall is rather complex. The known shelves typically have sufficient thickness to provide the required rigidity and require additional elements such as corner supports and the like for connection to the slat wall. Making a shelf of sufficient thickness involves a large consumption of materials. In the past, the manufacturing of such cantilever-type shelves and their assembly has been rather expensive because of the need for the additional material, the added weight of such material and the additional elements needed for supporting the shelf.

SUMMARY OF THE INVENTION

It is the primary object of the invention to provide an injection-molded plastic shelf which, while suitably wide, is nevertheless sufficiently rigid to support product thereon and yet would require less weight of plastic material than known cantilevered shelves of the same width and load-carrying capability.

Another object of the invention is to provide such a shelf which can be mounted in a "slat wall" without use of additional fixing elements.

A further object of the invention is to provide a shelf which is relatively lightweight, easy to handle and easy to secure in a slat wall and which, at the same time, will have an aesthetic appearance.

These and other objects of the invention which will become apparent hereafter are achieved by providing a shelf, which has a flat top surface for supporting goods thereon and a bottom surface with reinforcing ribs formed integrally with the bottom surface, and a frame extending peripherally of the bottom surface. To reduce the weight of the shelf, while at the same time substantially increasing the strength and rigidity thereof, the reinforcing ribs and the frame, which extends along the periphery of the bottom, are made hollow and are constructed such that the bores of the frame and the bores of the reinforcing ribs communicate with each other to form a network of communicating bores. The shelf is preferably rectangular and has an L-shaped lip extending along one longitudinal edge and projecting upwardly from the top surface. The lip is constructed to be received in a longitudinal groove in the slat wall thereby facilitating attachment of the shelf to the wall.

Accordingly, there is provided, in accordance with the invention, a shelf which is sufficiently rigid because of the presence of reinforcing ribs at the bottom thereof, without adding substantially to the weight and cost of material of the shelf. Providing an L-shaped lip, along one longitudinal side of the shelf, which projects from the top surface, insures easy attachment of the shelf to a complimentary groove in the wall.

As is known, the shelves used with slat walls having supporting grooves therein can be of different length. Accordingly, the pattern of ribs and frame may be selected in accordance with the length of a shelf. Preferably, for a shelf of comparatively short length there is provided a central rib which extends between opposite longitudinal portions of the frame and a plurality of ribs that extends between respective transverse portions of the frame and the central rib. The central rib has opposite ends that intersects the opposite longitudinal portions of the frame so that the bore of the central rib communicates with the bore of the frame, and the ribs extending between the transverse portions of the frame and the central rib also intersect the transverse portions and the central rib at their respective ends. Thereby, a closed network of communicating bores is formed. Preferably, the height of the reinforcing ribs is about half of the height of the frame portion.

When the shelf is somewhat longer, in an alternate embodiment of the invention the frame may include a second transverse wall portion extending between opposite longitudinal sides of the shelf and somewhat spaced from the border transverse walls. In this embodiment, there are provided short reinforcing ribs extending between adjacent transverse wall portions of the frame and the longitudinal ribs extend between the second wall portions of the frame and the central rib.

When the shelf is very long, in a third embodiment instead of a central rib there may be provided a central transverse frame wall portion. As in the previous embodiment, comparatively short reinforcing ribs extend between two adjacent transverse wall portions of the frame and much longer ribs extend between the central wall portion of the frame and the transverse portions of the frame remote from the edges of the shelf.

The above-mentioned and other features and objects of the invention and the manner of obtaining them will become more apparent and the invention itself will be best understood by reference to the following detailed description of preferred embodiments when read with reference to the accompanying drawings.

BRIEF DESCRIPTION OF THE DRAWINGS

FIG. 1 a perspective view of a shelf according to the present invention;

FIG. 2 is a bottom view of the shelf illustrative of one embodiment of the invention;

FIG. 3 is a cross-sectional side view along arrows AA in FIG. 2;

FIG. 4 is a longitudinal cross-sectional view along arrows BB in FIG. 2;

FIG. 5 is an enlarged, partial cross-sectional view of one of the ribs along arrows CC in FIG. 2;

FIG. 6 is a side view showing attachment of the shelf to a slat wall.

DETAILED DESCRIPTION OF PREFERRED EMBODIMENTS

A shelf 10 according to the invention and as shown in the figures has a base plate 12 having a top surface 14 and a bottom surface 16. As shown in FIG. 1, the top surface can be textured. The shelf is further provided with a tubular frame 18 extending peripherally of the bottom surface as best seen in FIG. 2. A central rib 20 extends between opposed longitudinal wall portions of the frame 18 and intersects these wall portions at each of its opposite ends. A plurality of ribs 22 extend in a spaced relationship between the transverse wall portions of the frame 18 and the central rib and intersect the respective transverse wall portions and the central rib at their opposite ends. As shown in FIG. 3, the shelf has an L-shaped lip 24 at the top surface thereof. One leg of the L-shaped lip is formed flush with the top surface, and the other leg of the L-shaped lip projects upward from the top surface. As shown in FIG. 6, the lip 24 extends into a groove B of slat wall A for attaching the shelf to the wall, so that the outer surface of the frame wall abuts the surface of the slat wall. As it can be seen, attachment of the shelf according to the invention is very simple. For attaching the shelf to the wall, all that is necessary is to insert the lip 24 into the L-shaped groove B of the slat wall.

As can be seen from FIGS. 3 and 4, the rear wall portion and the transverse and the side wall portions of the tubular frame 18 preferably have a shape of an irregular truncated pyramid. Of course, other shapes may be possible. The front longitudinal wall portion 26 of the frame 18 is made arcuate with the top surface of the shelf extending tangentially to the arch of the front portion forming a so-called "bull-nose". For aesthetic purposes, the height of the front portion is at least as large as the height of the other wall portions of the frame and can be even bigger. The ribs 20 and 22 preferably have a substantially triangular cross-sectional shape and height which is about half of the height of the frame. However, the rib height can also be the same as that of the transverse wall portions of the frame.

The hollow ribs according to the invention have a structural rigidity substantially equal to that of similar solid ribs of the same size and material, but require much less of the costly, heavy plastic material than would be needed for solid ribs. Also, since the ribs of the invention are integrally formed, the shelves may be much more economically produced than if a separate operation were required to attach, for example, separate supporting ribs or other reinforcement.

As shown in FIG. 5, the reinforcing rib 22 has a cross-section which is preferably substantially in the shape of an equilateral triangle the base of which is formed by a portion of the bottom surface itself. The thickness of the sides may be equal at most to the thickness of the shelf itself, or it may be substantially less, e.g., less than half of the shelf thickness. The vertexes of the triangle are generally rounded.

The shelves are preferably made of a high impact polystyrene, though other plastic materials of similar characteristics can also be used. The shelves according to the invention can be produced by known methods of injection molding. For example, a shelf according to the invention may be produced by a method similar to that described in U.S. Pat. No. 4,101,617 incorporated herein by this reference thereto.

The resulting construction of integrally molded hollow ribs and frame, forming a network of communicating bores, has several advantages. The network of communicating bores preferably forms a closed hydraulic system, the gas pressure of which may be affected by ambient temperature changes and/or stresses on portions of the shelf resulting from the uneven distribution of product carried thereon. Thus, gas pressure within the closed system will be substantially constant throughout and will remain generally constant throughout even though the pressure itself may vary as the result of the shelf being used, for example, interchangedly in heated or refrigerated areas of the store.

In other embodiments wherein a longer shelf is desired, as mentioned above, a second transverse wall portion may extend the width of the shelf adjacent the end tubular frame members and separated therefrom by short reinforcing ribs. In addition, the central rib 20 may be replaced by a further tubular frame member 18. However, in these additional embodiments and in accordance with the invention, as described above, the additional ribs and frame members still communicate with each other, forming a network of communicating bores.

While particular embodiments have been shown and described, various modifications thereof will be apparent to those skilled in the art and, therefore, it is not intended that the invention be limited to the disclosed embodiments or to the details thereof, and departures may be made therefrom within the spirit and scope of the invention as defined in the appended claims.

What is claimed is:

1. A one-piece injection-molded plastic shelf comprising a top surface for supporting goods thereon, an opposite bottom surface, integral tubular frame means extending substantially peripherally of said bottom surface and having a wall projecting downward from said bottom surface and defining an internal bore of said tubular frame means, and a plurality of ribs formed on said bottom surface integral therewith for reinforcing the same, each of said plurality of ribs having a longitudinal bore extending therethrough and at least one end of each rib intersecting said wall with the bore of each said rib communicating with the bore of said frame means so that the bores of said plurality of ribs and the internal bore of said tubular frame means form a network of communicating bores.

2. An injection-molded plastic shelf as set forth in claim 1 further comprising an integral L-shaped elongated longitudinal lip extending upwardly and outwardly of said surface along one longitudinal edge thereof and having one leg thereof projecting upward relative to said upper surface and the other leg thereof extending substantially flush with said top surface.

3. An injection-molded plastic shelf as set forth in claim 2 wherein said shelf is rectangular, and said lip extends along one of the longitudinal sides of said rectangular shelf.

4. An injection-molded plastic shelf as set forth in claim 1 wherein said tubular frame means extends along the entire periphery of said bottom surface.

5. An injection-molded plastic shelf as set forth in claim 1 wherein said shelf is rectangular, said wall having two opposed longitudinal portions and two opposed transverse portions connecting respective ends of said two opposed longitudinal portions, said plurality of ribs comprising a center transverse rib extending between said two longitudinal portions and having two opposed ends intersecting said two opposed longitudinal portions, a first plurality of spaced ribs extending between one of said opposed transverse portions of said wall and said center transverse rib and a second plurality of spaced ribs extending between the other of said opposed transverse portions of said wall and said center rib, each of said first and second plurality of ribs having one end thereof intersecting a respective transverse portion of said wall and the other end thereof intersecting said center rib with the bores of all said ribs communicating with the bore of said central rib and with respective bores of said transverse wall portions.

6. An injection-molded plastic shelf as set forth in claim 3 wherein said wall has a first longitudinal portion extending along the one of the longitudinal sides of said shelf and having a flat outer surface extending perpendicular to the other leg of said L-shaped lip, and an opposite second longitudinal portion having an arcuate outer surface, said top surface extending substantially tangentially to said arcuate outer surface.

7. An injection-molded plastic shelf as set forth in claim 6 wherein said second longitudinal portion of said wall projects further downward from said bottom surface than remaining portions of said wall.

8. An injection-molded plastic shelf as set forth in claim 7 wherein each of said plurality of ribs has a height that does not exceed a downward projection of said second longitudinal portion of said wall.

9. An injection-molded plastic shelf as set forth in claim 1 wherein each of said plurality of ribs has a cross-section of a substantially equilateral triangle including a base formed by a portion of the bottom surface and lateral sides defining a substantially triangular bore and having a thickness that does not exceed the thickness of said shelf.

10. An injection-molded plastic shelf as set forth in claim 9 wherein the thickness of said lateral sides is approximately half of the thickness of the shelf.

11. An injection-molded plastic shelf as set forth in claim 1 wherein said shelf is made of high impact polysterene.

12. A one-piece rectangular injection-molded plastic shelf comprising a top surface for supporting goods thereon; an opposite bottom surface; an integral L-shaped lip extending along a rear longitudinal edge of said top surface and having a first leg extending outwardly of said top surface substantially flush therewith and a second leg extending at a free end of said first leg upwardly thereof; integral tubular frame means extending substantially peripherally of said bottom surface and having a wall projecting downwardly of said bottom surface, defining an internal bore of said tubular frame means, and having a front arcuate convex longitudinal portion extending along a front edge of said bottom surface; and a plurality of ribs formed on said bottom surface integral therewith for reinforcing the same, each of said ribs having a longitudinal bore extending therethrough, and at least one end of each rib intersecting said wall with the bore of each rib communicating with the bore of said frame means so that the bores of said plurality of ribs and the internal bore of said frame means form a network of communicating bores.

13. An injection-molded plastic shelf as set forth in claim 12 wherein said plurality of ribs comprises a center transverse rib extending between said front longitudinal wall portion and a rear longitudinal wall portion of said wall and having two opposed ends intersecting said front and rear longitudinal wall portions with the bore of said transverse rib communicating with the bores of said front and rear longitudinal wall portions, and first and second pluralities of spaced ribs extending between two opposed transverse wall portions, respectively, and said central rib, each of said first and second plurality of ribs having one end thereof intersecting a respective transverse wall portion and the other end thereof intersecting said center rib with the bores of said first and second pluralities of ribs communicating with the bore of said central rib and respective bores of said two transverse wall portions.

14. An injection-molded plastic shelf as set forth in claim 13 wherein said rear longitudinal wall portion, said two opposed transverse wall portions, and each of said plurality of ribs have a height that does not exceed the height of said front arcuate convex longitudinal wall portion.

* * * * *